US006544350B2

(12) United States Patent
Muller et al.

(10) Patent No.: US 6,544,350 B2
(45) Date of Patent: Apr. 8, 2003

(54) AQUEOUS DETERGENT CONCENTRATES FOR ROUGH, ESPECIALLY PROFILED TILES AND FLAGS

(75) Inventors: Felix Muller, Velbert (DE); Jorg Peggau, Essen (DE); Helen Armstrong, Longsight (GB)

(73) Assignee: Goldschmidt, AG, Essen (DE)

( * ) Notice: Subject to any disclaimer, the term of this patent is extended or adjusted under 35 U.S.C. 154(b) by 0 days.

(21) Appl. No.: 09/909,308

(22) Filed: Jul. 19, 2001

(65) Prior Publication Data

US 2002/0169093 A1 Nov. 14, 2002

(30) Foreign Application Priority Data

Aug. 4, 2000 (DE) ..... 100 38 198

(51) Int. Cl.[7] ..... B08B 3/04; C11D 3/26; C11D 3/30; C11D 1/62

(52) U.S. Cl. ..... 134/42; 510/238; 510/240; 510/421; 510/422; 510/423; 510/424; 510/433; 510/504; 510/435

(58) Field of Search ..... 510/238, 421, 510/422, 423, 424, 427, 433, 435, 504, 240; 134/42

(56) References Cited

U.S. PATENT DOCUMENTS

| | | | | | |
|---|---|---|---|---|---|
| 6,022,841 | A | * | 2/2000 | Lu et al. | 510/384 |
| 6,239,092 | B1 | * | 5/2001 | Papasso et al. | 510/238 |
| 6,268,327 | B1 | * | 7/2001 | Lu et al. | 510/384 |
| 6,440,916 | B1 | * | 8/2002 | Cheung et al. | 510/238 |
| 6,465,411 | B2 | * | 10/2002 | Manske et al. | 510/417 |

* cited by examiner

*Primary Examiner*—Gregory Delcotto
(74) *Attorney, Agent, or Firm*—Scully, Scott, Murphy & Presser

(57) ABSTRACT

Aqueous detergent concentrates for rough, especially profiled tiles and flags, based on nonionic, anionic, amphoteric surfactants, with or without the use of customary auxiliaries and additives, said concentrates comprising quaternary alkoxylated amine compounds as cleaning enhancers.

14 Claims, 1 Drawing Sheet

AQUEOUS DETERGENT CONCENTRATES FOR ROUGH, ESPECIALLY PROFILED TILES AND FLAGS

DESCRIPTION

Field of the Invention

The present invention relates to aqueous detergent concentrates for rough, especially profiled stoneware tiles and flags, based on nonionic, anionic or amphoteric surfactants and, more particularly, to aqueous detergent concentrates comprising quaternary alkoxylated amine compounds as cleaning enhancers.

BACKGROUND OF THE INVENTION

For reasons of esthetics and hygiene, work areas, hallways and staircases within both commercial and public buildings and shopping malls are increasingly being laid with natural and stoneware tiles and flags.

In order to avoid accidents due to tripping and slipping, these floor coverings are required to meet certain requirements in respect of their sureness underfoot; thus these floor coverings are required by statutory provisions (the guidelines of the German Workplaces Ordinance) to be level, slip resistant, and easy to clean.

The term stoneware is representative of hard-fired tiles and flags which may be glazed or unglazed, with or without a fired ceramic surface coating. In accordance with the DIN Standard, there is a subdivision according to water absorption and production method; DIN EN 176 defines stoneware tiles and fine-stoneware tiles.

For slipproof properties, however, it is the surface roughness which is critical. Consequently, the data sheets of the trade association (ZH 1/571) and of the municipal accident prevention authorities (GUV 26.17; 26.18) specify precisely defined nonslip classes (R classes) for the various areas of application, with higher R values standing for greater slip resistance.

The R values are determined in accordance with DIN 51 130 in tests on a sloping plane, and are reported in incline angle ranges, for example, R 9=3°–10° incline angle; R 10=10°–19° incline angle; R 11=19°–27° incline angle; R 12=27°–35° incline angle; and R 13=>35° incline angle.

For profiled flags and tiles, the displacement volume (V) is also reported in accordance with DIN 51 130. The displacement volume is the volume between the upper walking plane and the lower water removal plane. It lies between V 4(=4 $cm^3/dm^2$) and V 10(=10 $cm^3/dm^2$).

For areas with increased risk of slippage, i.e., areas in which floors and steps come into contact with friction-reducing and/or slip-promoting media such as water, wastes, starchy residues, animal and vegetable fats or oils, mineral fats or oils, soaps, pigment dirt, abraded rubber, and silicones, the appropriate evaluation groups are >R 10, especially R 12 and R 13.

Tiles and flags are generally considered as easy to care for and pleasant to clean. This is undoubtedly true of level, smooth and hard substrates of R classes 9 to 11. As the R class goes up, however, the roughness of the surfaces increases. Those considered problematic are slightly rough substrates of class R 12 and, in particular, profiled tiles and flags of classes R 12 to R 13 and V 8 to 10, known as fine stoneware tiles/flags.

Cleaning effort is increased considerably as the roughness/uneveness of the substrate increases, especially if porosity results in additional increase in the size of the surface.

Numerous attempts have been made in the prior art to develop new cleaning methods and specialized mechanical cleaners that are tailorly made for a particular type of flooring and/or soiling. Additionally, various all-purpose cleaners have been reported in the prior art which minimize cleaning efforts and/or optimize the cleaning effect.

Commercially available detergents of the prior art for manual and machine cleaning are, generally complex mixtures of anionic, nonionic and amphoteric/zwitterionic surfactants which comprise customary auxiliaries and additives such as alkalis, complexing agents, solubilizers, chlorine bleaching lye additives, and—if desired—mild abrasives. These commercially available prior art detergents are employed in concentrations ranging from about 0.5 to 10% by weight.

In practice, however, it is often impossible to remove soiling fully on fine stoneware substrates in the first pass. The same is true even when mechanical means such as microfiber pads, scrubbers, high pressure apparatuses, abrasive suction rollers or brush rollers, and additional intensive rinsing with water are used. Additional cleaning steps are therefor necessary.

Apart from the considerable additional expense on operatives and machinery, and the additional environmental burden of detergents, the abrasive action of mechanical exposure reduces more quickly the sureness of the floor covering underfoot.

It is an object of the present invention, therefore, to overcome these disadvantages of known, commercially available detergents and to provide improved detergents which, used at the same or reduced concentrations, ensure reliable cleaning of rough and profiled tiles and flags, known as fine stoneware.

SUMMARY OF THE INVENTION

The foregoing object is achieved by employing detergents which are based on surfactants and comprise quaternary alkoxylated amine compounds as cleaning enhancers.

The present invention accordingly provides aqueous detergent concentrates for rough, especially profiled tiles and flags, which are based on nonionic, anionic, amphoteric surfactants, with or without the use of customary auxiliaries and additives, said concentrates comprising quaternary alkoxylated amine compounds as cleaning enhancers.

The present invention further provides aqueous detergent concentrates which comprise, based on the overall mixture, with the exception of water, substantially from 0.1 to 10, in particular from 1 to 10, parts by weight of at least one anionic surfactant, optionally from 0.0 to 20, in particular from 5 to 15, parts by weight of at least one nonionic surfactant, optionally from 0.0 to 10, in particular from 1 to 6, parts by weight of at least one amphoteric/zwitterionic surfactant, and optionally from 0.1 to 10 parts by weight of customary auxiliaries and additives, wherein said concentrates comprise from 0.1 to 5, in particular from 0.5 to 3, parts by weight of alkoxylated amine compounds of the general formula $$[R^1, R^2, R^3, R^4N]^+X^-$$

where $R^1$ is a straight-chain, optionally branched, alkyl radical, optionally containing multiple bonds and having from 8 to 22, in particular from 8 to 18, carbon atoms, $R^2$ is $—(CH_2CHR^5O)_n—R^6$ where $R^5$ is H, $—CH_3$, or $—C_2H_5$; $R^6$ is H, $—CH_3$, $C_2H_5$, $—C_3H_7$ or $—C_4H_9$ and n=1 to 25, in particular 2 to 15, $R^3$ is $R^1$ or $R^2$, $R^4$ is $—CH_3$ or $—C_2H_5$ and $X^-$ is an anionic radical, especially methyl sulfate, ethyl sulfate, phosphate, chloride, bromide, or iodide as cleaning enhancers.

The present invention further provides for the use of the aqueous detergent concentrates as claimed in one or more of the claims to clean fine stoneware tiles.

Further subject matter of the present invention is indicated by the claims.

DETAILED DESCRIPTION OF THE INVENTION

Figure 1A:
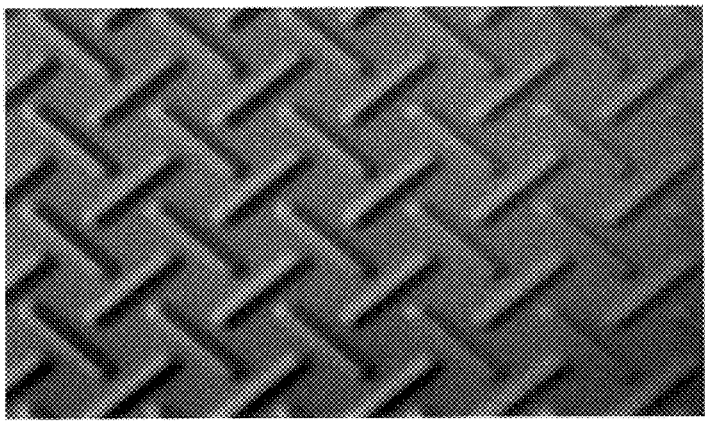
FIGS 1A–C are photographs of different stoneware tiles employed in the present invention.

The aqueous detergent concentrates of the present invention contain, based on the overall mixture, water in the range from about 45 to about 95 parts by weight, preferably from about 70 to about 90 parts by weight. For use, the invention concentrates may be diluted with additional water to the particular desired and/or customary or necessary use concentration of from about 0.5 part by weight to about 10 parts by weight.

The cleaning enhancers used in accordance with the present invention are alkoxylated amine compounds of the general formula $$[R^1, R^2, R^3, R^4N]^+X^-$$

where $R^1$ is a straight-chain, optionally branched, alkyl radical, optionally containing multiple bonds and having from 8 to 22 carbon atoms, $R^2$ is $—(CH_2CHR^5O)_n—R^6$ where $R^5$=H, $—CH_3$, or $—C_2H_5$; $R^6$=H, $—CH_3$, $C_2H_5$, $—C_3H_7$ or $—C_4H_9$ and n=1 to 25, in particular 2 to 15, $R^3$ is $R^1$ or $R^2$, $R^4$ is $—CH_3$ or $—C_2H_5$ and $X^-$ is an anionic radical, such as methyl sulfate, ethyl sulfate, phosphate, chloride, bromide, or iodide.

Highly preferred compounds of the present invention include compounds wherein $R^1$ is based on fatty amines, prepared by known processes such as the reaction of natural fatty acids with ammonia and subsequent hydrogenation.

Particularly suitable fatty acids in this context are coconut fatty acid, palm fatty acid, and tallow fatty acid, which have a chain distribution of from about 6 to about 20, primarily from about 8 to about 18, carbon atoms and may be either saturated or unsaturated. By means of known processes, it is possible for some or all of the double bonds to be hydrogenated, so that the iodine numbers are situated within the range from about 0 to about 50, in particular in the range from about 15 to about 40.

Suitable alkoxylating agents include ethylene oxide, propylene oxide or butylene oxide, alone or as copolymers with both random and block distribution. The degree of alkoxylation is codetermined by the target hydrophilicity of the compound. The degree of alkoxylation is, on average, between 1 and 25, in particular from 2 to 15. Where $R^3$=$R^2$, this figure applies to both radicals together. Particular preference is given in accordance with the present invention to ethoxylated compounds having a degree of alkoxylation of approximately 5 to 10.

Compounds of this kind are commercially available products and are sold, for example, by the companies Goldschmidt Rewo and Goldschmidt Chemical Corporation under the brand names REWOQUAT® or ADOGEN®, such as REWOQUAT® CPEM or ADOGEN® 66.

These compounds are added to cleaning formulations which consists of mixtures of one or more surfactants that are selected from the group consisting of anionic, nonionic and amphoteric compounds and, if desired, customary auxiliaries and additives such as alkalis, complexing agents, solubilizers, chlorine bleaching solution additives, and mild abrasives, in amounts of from about 0.1 to 5, in particular from 0.5 to 3, parts by weight.

Surprisingly, the cationic cleaning enhancers of the present invention do not display the tendency to form insoluble complexes and precipitate in the presence of anionic compounds.

Moreover, the inventive cationic cleaning enhancers do not improve the values of a single technical effect at the expense of other properties, but instead lift the general level overall. For example, the inventive cationic cleaning enhancers provide:

(i) better spreading on porous surfaces, e.g., fine stoneware tiles (optimized wetting, particularly on porous surfaces—where the real surface area is a multiple of the actual footprint area—leads to better soil detachment. The shadow regions of the antislip elevations are also wetted and cleaned adequately.)

(ii) better lime soap dispersing capacity (optimized dispersing capacity: for insoluble inorganic soiling, prevents the settling of such soiling. This is particularly important on porous surfaces, since these residues are otherwise impossible to remove).

(iii) better emulsifying capacity for simple, inexpensive surfactant systems: (optimized emulsifiability, since the entire oil is present continuously in the emulsion. Where there is settling of water, resoiling owing to a breaking emulsion does not occur). In order not to reduce the slip resistance properties, it is especially important here to remove all residues completely, so that the required pores do not become clogged.

The surface-active compounds that can also be used in accordance with the present invention are any anionic, nonionic, and/or amphoteric/zwitterionic surfactants that are typically employed in this field for preparing domestic and industrial detergents.

The surface-active compounds may be used individually, or alternatively, as mixtures and are, for example, anionic, nonionic and amphoteric surfactants such as alkali metal, ammonium or magnesium alkyl sulfates and alkyl ether sulfates, secondary alkane sulfonates, alkali metal α-olefin sulfonates, sulfosuccinates, acyl isethionates, sarcosides, taurides, alkyl polyglucosides, ether citrates, carboxylates, ether carboxylates, alkylamide ether sulfates, and also ethoxylates of fatty alcohols, glycerides, oils, fatty acids, and fatty acid esters, amine oxides, alkyl betaines, alkylamido betaines, propionates, glycinates, acetates and sulfobetaines, and sodium soap, potassium soap or triethanolamine soap.

The customary or possible compounds of the individual groups that can be used in this field are part of the skilled worker's general knowledge and may additionally be looked up if required in the relevant technical literature and also in the manufacturers' formula recommendations for the respective classes of surfactant.

The following examples are given to illustrate some advantages that are obtained from the present invention.

EXAMPLES

Test Products

Cleaning Enhancers Used

Test product 1:

REWOQUAT® CPEM

Test product 2:

ADOGEN® 66

Test product 3:

Capryl bis-polyethoxymethylammonium chloride

Test product 4:

Capryl bis-polyethoxymethylammonium ethosulfate

Test product 5:

Coco bis-polyethoxymethylammonium chloride

Test product 6:

Coco bis-polyethoxymethylammonium methosulfate

Test product 7:

Coco bis-polyethoxymethylammonium ethosulfate

Test product 8:

Coco pentaethoxymethylammonium ethosulfate

Test product 9:

Tallow bis-polyethoxymethylammonium methosulfate

Test product 10:

REWOQUAT® CQ

Fine Stoneware Tiles Used

Figure 1B:
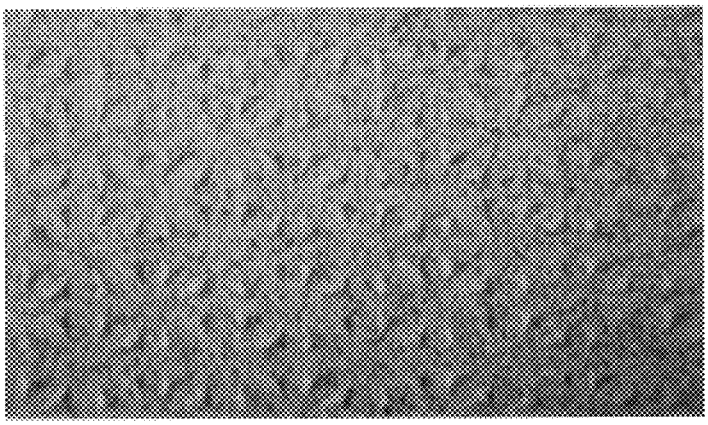
Figure 1C:
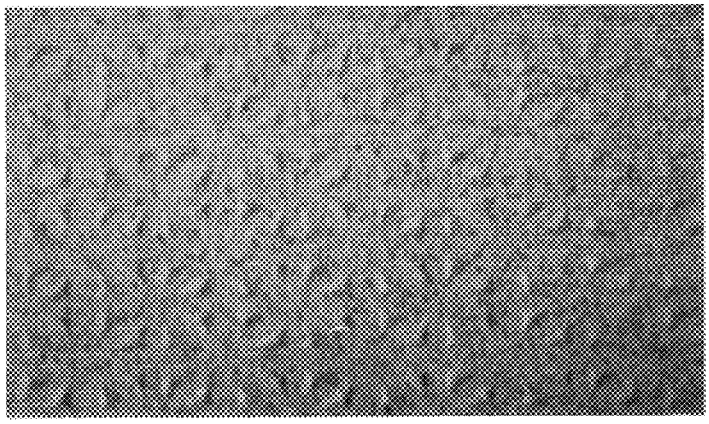

Light-colored fine stoneware tiles Type No.: 2292, Classification: R 13 V 10, manufacturer: Villeroy & Boch AG Tiles with different test surfaces, i.e., Test surface stoneware A, Test surface stoneware B, and Test surface stoneware C as shown in FIGS. 1A–C, respectively, were employed.

Detergents

Composition of Commercially Available Detergents

| | Surfactants | | | Builders | | | |
|---|---|---|---|---|---|---|---|
| | Non-ionic | Anionic | Ampho-teric | Alkalis | Complexing agents | Alcohols | pH |
| A | 5–15% | | <5% | + | + | | 13 |
| B | 5–15% | | <5% | + | | + | 11 |
| C | 5–15% | | | + | | | 11 |

+ = present

Base Detergent

| | % by weight |
|---|---|
| Test product D (base D) | |
| TEGOTENS EC 11 (decyl ethoxylate, end-capped) | 10 |
| REWOPOL D 510 (sodium isooctyl sulfate) | 9 |
| Na stearate | 1.2 |
| TEGOTENS DO (decamine oxide) | 4.35 |
| Triethanolamine | 2.0 |
| IDS (30%, sodium iminosuccinate) | 0.9 |
| Water | |

-continued

| | % by weight |
|---|---|
| Test product E (base E) | |
| REWOPOL D 510 (sodium isooctyl sulfate) | 4.8 |
| REWOPOL SBDO 75 (diisooctyl sulfosuccinate) | 0.9 |
| Na phosphonate DTPMP | 0.32 |
| Water | |

Typical Service of the Floor Cleaners

| | | |
|---|---|---|
| A | 3.0% | Particularly for professional fine stoneware clearing |
| B | 0.9% | Normal general-purpose household floor cleaner |
| C | 0.9% | Normal general-purpose household floor cleaner |
| Base D | 0.3% | Highly concentrated floor cleaner |
| Base E | 1.2% | Floor cleaner with base surfactants |

Performance Testing 1.1 Spreading Testing

The cleaning solution was diluted with respect to use concentration using mains water from the city of Essen (water hardness<10). For the test, the tip of a pipette (from Rainin (2.5 ml) EPD 2) was positioned 0.3 mm above the tile.

The fine stoneware tiles were first washed in a dishwasher at 70° C. without surfactant.

For the spreading test, 0.05 ml of cleaner use solution was pipetted onto the tile.

After 60 seconds, the length and width of the area of spread was determined using a caliper square. For error correction, each solution was repeated at least five times. The surface area of the droplet is calculated using the formula for an ellipse. Calculation $$\text{Wetting area} = p \cdot \text{height} \cdot \text{width}$$

The properties of the base solution are taken as the blank value. Following the addition of the cleaning enhancer, comparison is made in relation to the blank value.

TABLE 1

Spreading properties of commercial products diameter of the droplet (0.05 ml) on fine stoneware tiles

| | Original | +1% REWOQUAT CPEM | +1% ADOGEN 66 |
|---|---|---|---|
| A in 3.0% strength solution | 5.2 $cm^2$ | 52.8 $cm^2$ | 32.1 $cm^2$ |
| Increase [%] | | 1023% | 622% |
| B in 0.9% strength solution | 55.2 $cm^2$ | 57.9 $cm^2$ | 55.7 $cm^2$ |
| Increase [%] | | 105% | 101% |
| C in 0.9% strength solution | 70.2 $cm^2$ | 78.7 $cm^2$ | 79.5 $cm^2$ |
| Increase [%] | | 112% | 113% |

TABLE 2

Spreading properties of comparative formulations
Diameter of the droplet (0.05 ml) on fine stoneware tiles

| | Wetted area $cm^2$ | Increase [%] |
|---|---|---|
| Table 2a-Stoneware surface A<br>Base cleaner D in 0.3% strength solution | | |
| Base Original | 3.3 | — |
| +1% Test product 1 | 26.1 | 797 |
| +1% Test product 2 | 18.2 | 558 |
| +2% Test product 1 | 16.2 | 495 |
| +2% Test product 2 | 12.2 | 402 |
| +2% Test product 3 | 9.6 | 291 |
| +2% Test product 4 | 7.8 | 236 |
| +2% Test product 5 | 16.9 | 512 |
| +2% Test product 6 | 7.5 | 228 |
| +2% Test product 7 | 7.1 | 215 |
| +2% Test product 8 | 16.3 | 494 |
| +2% Test product 9 | 8.0 | 242 |
| +2% Test product 10 | 7.6 | 230 |
| Table 2b-Stoneware surface B<br>Base cleaner D in 0.6% strength solution | | |
| Base Original | 11.4 | — |
| +2% Test product 1 | 11.4 | 100 |
| +2% Test product 2 | 13.3 | 117 |
| +2% Test product 3 | 19.0 | 167 |
| +2% Test product 4 | 30.4 | 267 |
| +2% Test product 5 | 14.3 | 125 |
| +2% Test product 6 | 21.8 | 191 |
| +2% Test product 7 | 35.6 | 312 |
| +2% Test product 8 | 29.8 | 261 |
| +2% Test product 9 | 17.7 | 155 |
| +2% Test product 10 | 37.5 | 329 |
| Table 2c-Stoneware surface A<br>Base cleaner E in 1.2% strength solution | | |
| Base Original | 3.5 | — |
| +1% Test product 1 | 12.0 | 347 |
| +1% Test product 2 | 12.3 | 358 |
| +2% Test product 1 | 13.3 | 386 |
| +2% Test product 2 | 14.3 | 415 |
| Table 2d-Stoneware surface B<br>Base cleaner E in 1.2% strength solution | | |
| Base Original | 9.0 | — |
| +2% Test product 3 | 123.5 | 1372 |
| +2% Test product 4 | 104.9 | 1166 |
| +2% Test product 5 | 115.3 | 1281 |
| +2% Test product 6 | 111.8 | 1242 |
| +2% Test product 7 | 113.0 | 1255 |
| +2% Test product 8 | 52.4 | 583 |
| +2% Test product 9 | 103.0 | 1144 |

TABLE 2-continued

Spreading properties of comparative formulations
Diameter of the droplet (0.05 ml) on fine stoneware tiles

| | Wetted area $cm^2$ | Increase [%] |
|---|---|---|
| Table 2e-Stoneware surface C<br>Base cleaner E in 1.2% strength solution | | |
| Base Original | 13.4 | — |
| +2% Test product 3 | 41.9 | 312 |
| +2% Test product 4 | 28.0 | 209 |
| +2% Test product 5 | 44.2 | 330 |
| +2% Test product 6 | 45.8 | 342 |
| +2% Test product 7 | 48.7 | 363 |
| +2% Test product 8 | 20.2 | 150 |
| +2% Test product 9 | 32.5 | 242 |

Lime Soap Dispersing Capacity

Test on the lines of the publication: Lime Soap Dispersion Test, Journal of American Oil Chemists' Society, Volume 27, March 1950, p. 90, H. C. Boghetty & C. A Bergman, Organic Chemicals Division, General Dyestuff, N.Y.C.

Objective

The test determines the capacity of a cleaner use solution [s] to disperse poorly soluble metal salts.

Test Solutions 0.5 g Na oleate/100 ml (prepared from 2.8 g/100 ml gold soap)

water with 1 g/1 carbonate hardness (prepared from 0.986 g $MgSO_4$+0.882 g $CaCl_2$ in 1 liter of demineralized water)

suitable service dilution of the cleaner as titrant (measuring range: 0 to 15 ml of this solution).

Method 5 ml of sodium oleate (1) are pipetted together with X ml of a cleaner use solution (3) and 10 ml of hard water (2) and then made up to 30 ml with demineralized water. The test solution is inverted twenty times and then assessed visually after 30 seconds. If the amount of dispersant is inadequate, the line soap which forms precipitates in the form of clouds in the solution. The end point is reached when the soap has dispersed.

$$\textit{Required amount of cleaner}\,[g] = \frac{X\ \text{ml}(\textit{cleaner solution})\cdot\%(\textit{use concentration})}{100}$$

$$\textit{Dispersing capacity}\,[\%] = \frac{0.025(\textit{test amount of Na oleate})}{\textit{required amount of cleaner}\,[g]}\cdot 100$$

TABLE I

| Solution | Concentration [%] | Required amount of cleaner solution [ml] | Required amount of cleaner concentrate [g] | Dispersing capacity [%] |
|---|---|---|---|---|
| Commercial product A | 0.5 | 6 | 0.03 | 83 |
| A + 1% REWOQUAT CPEM | 0.5 | 5 | 0.025 | 100 |
| A + 2% REWOQUAT CPEM | 0.5 | 4 | 0.02 | 125 |
| A + 1% Adogen 66 | 0.5 | 5 | 0.025 | 100 |
| A + 2% Adogen 66 | 0.5 | 4 | 0.02 | 125 |
| Commercial product B | 0.5 | 4 | 0.02 | 125 |
| Commercial product C | 0.5 | 8 | 0.04 | 63 |

TABLE I-continued

| Solution | Concentration [%] | Required amount of cleaner solution [ml] | Required amount of cleaner concentrate [g] | Dispersing capacity [%] |
|---|---|---|---|---|
| Test product D | 0.15 | 11 | 0.0165 | 152 |
| D + 1% REWOQUAT CPEM | 0.15 | 10 | 0.015 | 167 |
| D + 2% REWOQUAT CPEM | 0.15 | 10 | 0.015 | 167 |
| D + 1% Adogen 66 | 0.15 | 9 | 0.0135 | 185 |
| D + 2% Adogen 66 | 0.15 | 8 | 0.012 | 208 |
| Test product E | 5 | 14 | 0.7 | 4 |
| E + 1% REWOQUAT CPEM | 1.2 | 12 | 0.144 | 17 |
| E + 2% REWOQUAT CPEM | 1.2 | 9 | 0.108 | 23 |
| E + 1% Adogen 66 | 1.2 | 6 | 0.072 | 35 |
| E + 2% Adogen 66 | 1.2 | 4 | 0.048 | 52 |

1.2 Emulsifying Behavior

Here, only the behavior of test solution E was investigated, since with the other cleaners the high proportion of nonionic surfactants did not suggest any distinct increase in the emulsifying behavior. Test solution E contains only short-chain anionic surfactants, and surfactant systems of this kind are known to have a weakness in terms of emulsifying behavior.

Test Method 100 g of use solution of a cleaner were mixed with 90 g (=100 ml) of olive oil. The mixture was then emulsified in an Ultra-Turrax T25 at 8000 rpm for 30 seconds. This emulsion is placed in a 250 ml graduated cylinder. After 15, 30, 60, 120, and 180 minutes, and after 24 hours, the volume proportion of the individual phases is read off.

TABLE II

| | | 100 ml olive oil + 100 g 1.2% base E | 100 ml olive oil + 100 g 1.2% base E (with 1% CPEM) | 100 ml olive oil + 100 g 1.2% base E (with 2% CPEM) | 100 ml olive oil + 100 g 1.2% base E (with 1% Adogen 66) | 100 ml olive oil + 100 g 1.2% base E (with 2% Adogen 66) |
|---|---|---|---|---|---|---|
| 00:15 | Foam | | 6 | 7 | 6 | 10 |
| | Oil | 79 | | | 2 | |
| | W/o emulsion | | 150 | 160 | 190 | 194 |
| | Mixed phase | | | | | |
| | o/w emulsion | 120 | | | | |
| | Water | | 45 | 36 | 4 | |
| 00:30 | Foam | | 6 | 6 | 5 | 2 |
| | Oil | 93 | | | 2 | |
| | w/o emulsion | | 130 | 132 | 184 | 188 |
| | Mixed phase | | | | | |
| | o/w emulsion | 106 | | | | |
| | Water | | 68 | 64 | 10 | 10 |
| 01.00 | Foam | | | 2 | 3 | |
| | Oil | 97 | | | 3 | |
| | w/o emulsion | | 112 | 114 | 176 | 180 |
| | Mixed phase | | | | | |
| | o/w emulsion | 102 | | | | |
| | Water | | 88 | 84 | 18 | 20 |
| 02:00 | Foam | | | | 3 | |
| | Oil | 99 | | | 3 | |
| | w/o emulsion | | 50 | 50 | 158 | 170 |
| | Mixed phase | | | | | |
| | o/w emulsion | 100 | 60 | 58 | | |
| | Water | | 95 | 92 | 36 | 30 |
| 03:00 | Foam | | | | 2 | |
| | Oil | 99 | | | 4 | |
| | w/o emulsion | | 60 | 64 | 144 | 165 |
| | Mixed phase | | | 4 | | |
| | o/w emulsion | 100 | 48 | 38 | | |
| | Water | | 96 | 94 | 50 | 35 |
| 1 day | Foam | | | | | |
| | Oil | 99 | 8 | 5 | 5 | |
| | W/o emulsion | | 88 | 91 | 115 | 165 |
| | Mixed phase | | 4 | 6 | | |
| | O/w emulsion | 100 | | | | |
| | Water | | 98 | 98 | 80 | 72 |

Result

As is evident, the emulsifying behavior of weakly emulsifying, short-chain anionic surfactant solutions is greatly optimized through the addition of the cleaning enhancers of the present invention. If the emulsion breaks, water settles instead of the oil. This setting water does not effect the cleaning power or soil carrying capacity during a cleaning operation.

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the spirit and scope of the appended claims.

What is claimed is:

1. A method for cleaning fine stoneware tile comprising: applying an aqueous detergent concentrate to fine stoneware tile needing cleaning, wherein said aqueous detergent concentrate comprises at least one surfactant selected from the group consisting of nonionic, anionic, amphoteric/zwitterionic and mixtures thereof, and from 0.1 to 5 parts by weight of a quaternary alkoxylated amine cleaning enhancer having the general formula $[R^1, R^2, R^3, R^4N]^+X^-$ where $R^1$ is a straight-chain, optionally branched, alkyl radical, optionally containing multiple bonds and having from 8 to 22 carbon atoms, $R^2$ is. $—(CH_2CHR^5O)_n—R^6$ where $R^5$=H, $—CH_3$, or $—CH_2H_5$; $R^6$=H, $—CH_3$, $C_2H_5$, $—C_3H_7$ or $—C_4H_9$ and n=1 to 25, $R^3$ is $R^1$ or $R^2$, $R^4$ is $—CH_3$ or $—C_2H_5$ and $X^-$ is an anionic radical.

2. The method of claim 1 comprising, based on the overall mixture, with the exception of water, from 0.1 to 10 parts by weight of at least one anionic surfactant.

3. The method of claim 2 comprising 0.0 to 20 parts by weight of at least one nonionic surfactant.

4. The method of claim 2 comprising 0.0 to 10 parts by weight of at least one amphoteric/zwitterionic surfactant.

5. The method of claim 2 further comprising 0.1 to 10 parts by weight of customary auxiliaries and additives.

6. The method of claim 1 wherein said quaternary alkoxylated amine compound has the general formula $$[R^1, R^2, R^3, R^4N]^+X^-$$

in which $R^1$ is a straight-chain alkyl radical containing multiple bonds and having from 12 to 18 carbon atoms, $R^2$ and $R^3$=$—(CH_2CHR^5O)_n—R^6$ where $R^5$=H; $R^6$=H, and the sum of all indices n in total=5 to 20, $R^4$ is $—CH_3$ and $X^-$=methyl sulfate, ethyl sulfate, or chloride.

7. The method of claim 6, wherein $R^1$ is a radical of coconut fatty acid, palm fatty acid, or tallow fatty acid.

8. The method of claim 1 wherein said cleaning enhancer is coco-pentaethoxy-methylammonium methosulfate, ethyl-bis-(polyethoxyethanol)-tallowammonium ethosulfate or mixtures thereof.

9. The method of claim 2 wherein said at least one anionic surfactant is present in an amount of from 1 to 10, parts by weight.

10. The method of claim 2 wherein said at least one nonionic surfactant is present in an amount of from 5 to 15 parts by weight.

11. The method of claim 2 wherein said at least one amphoteric/zwitterionic surfactant is present in an amount of from 1 to 6 parts by weight.

12. The method of claim 2 wherein said alkoxylated amine is present in an amount of from about 0.5 to 3 parts by weight.

13. The method of claim 1 further comprising an auxiliary or an additive.

14. The method of claim 13 wherein said auxiliary or additive are selected from the group consisting of alkalis, complexing agents, solubilizers, chlorine bleaching solution additives, and mild abrasives.

* * * * *